US005469837A

United States Patent [19]

Chiang et al.

[11] Patent Number: 5,469,837

[45] Date of Patent: Nov. 28, 1995

[54] SMOKE EXHAUSTER HAVING CLEANING DEVICE

[76] Inventors: Chao-Cheng Chiang; Chi-Shyong Chiang, both of P.O. Box 63-151, Taichung, Taiwan

[21] Appl. No.: 363,923

[22] Filed: Dec. 27, 1994

[51] Int. Cl.[6] ..... F24C 15/20

[52] U.S. Cl. ..... 126/299 D; 126/299 R

[58] Field of Search ..... 126/299 E, 299 R, 126/299 D; 55/DIG. 36; 134/177, 172

[56] References Cited

U.S. PATENT DOCUMENTS 4,323,373 4/1982 Fritz ..... 126/299 D X
5,158,429 10/1992 Chiang et al. ..... 126/299 E X
5,228,428 7/1993 Jang ..... 126/299 R X
5,230,327 7/1993 Jang et al. ..... 126/299 R
5,323,762 6/1994 Chiang et al. ..... 126/299 E

*Primary Examiner*—Larry Jones

[57] ABSTRACT

A smoke exhauster includes a housing having an opening for receiving an annular tray and a grill. The grill includes a passage having one end located below a drain hole of the annular tray for receiving the fluid and having the other end extended toward the center portion. A container is secured to the center portion of the grill for collecting fluid from the passage, the container including a tube disposed in the center portion for supplying water into the housing for cleaning the housing. The grill and the tray both may be easily secured to the housing.

5 Claims, 4 Drawing Sheets

SMOKE EXHAUSTER HAVING CLEANING DEVICE

BACKGROUND OF THE INVENTION

1. Field of the Invention

The present invention relates to a smoke exhauster, and more particularly to a smoke exhauster which can be easily cleaned.

2. Description of the Prior Art

The closest prior arts of which applicants are aware are their prior U.S. Pat. No. 5,158,429 to Chiang et al, and U.S. Pat. No. 5,323,762 to Chiang et al. In both patents, motor means are required to be installed within the smoke exhauster for pumping water to clean the smoke exhauster. In addition, detergent materials are required to be added into the container which is required to be attached to the smoke exhauster before cleaning operations.

The present invention has arisen to mitigate and/or obviate the afore-described disadvantages of the conventional smoke exhausters.

SUMMARY OF THE INVENTION

The primary objective of the present invention is to provide a smoke exhauster which can be easily cleaned without providing a motor therein.

In accordance with one aspect of the invention, there is provided a smoke exhauster comprising a housing including an opening formed therein, an annular tray engaged in the opening for collecting fluid and including a first drain hole formed therein for draining the fluid, a grill engaged below said annular tray and engaged in the opening, the grill including a center portion and including a passage extended radially therein, the passage including a first end located below the first drain hole of the annular tray for receiving the fluid and including a second end extended toward the center portion thereof for guiding the fluid to the center portion, means for securing the grill to the housing and for retaining the annular tray in the opening, and a container secured to the center portion of the grill for collecting fluid from the passage, the container including a center portion having a tube provided therein, the tube including an upper end extended toward the opening of the housing and including a lower end for supplying water into the housing for cleaning the housing.

The grill includes a basin provided in the center portion thereof, the passage is connected to the basin for guiding the fluid to the basin, the basin includes at least one aperture formed therein for draining the fluid to the container.

The annular tray includes an open top having an annular partition extended upward therefrom so as to define two annular space in the annular tray, the annular partition includes an orifice formed therein for communicating the annular spaces.

The container includes a bottom portion having a hub convex upward therefrom, the tube is vertically secured in the hub. The container includes a second drain hole for draining the fluid.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
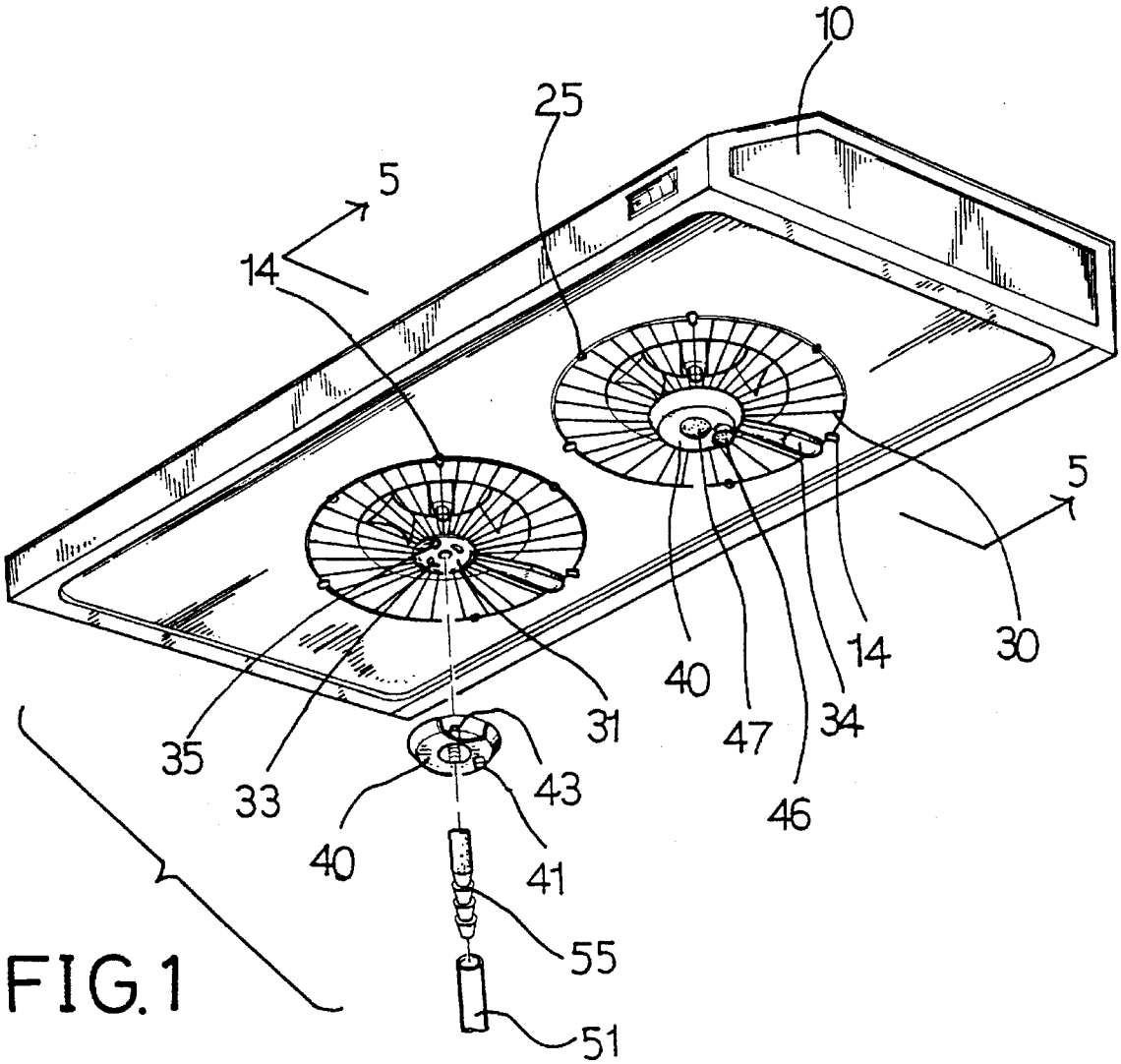
FIGS. 1 and 2 are partial exploded views of a smoke exhauster in accordance with the present invention.
Figure 3:
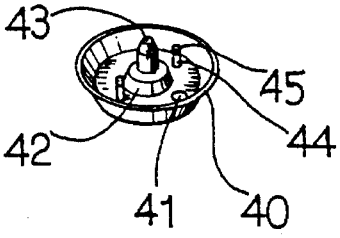
FIG. 3 is a top perspective view of a container.
Figure 4:
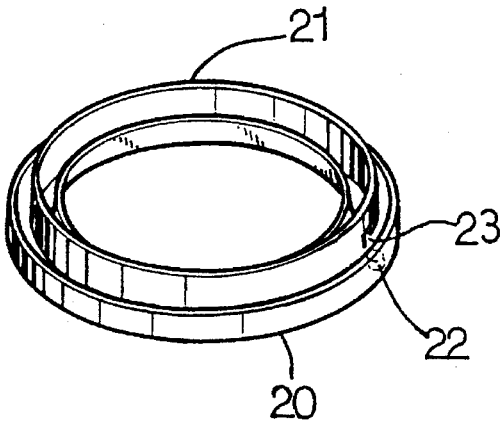
FIGS. 4 and 5 are cross sectional views taken along lines 4—4 of FIG. 1.

Referring to the drawings, and initially to FIGS. 1 to 5 and 2A, a smoke exhauster in accordance with the present invention comprises a housing 10 including an opening 11 formed therein and including a motor 12 and a fan 13 disposed within the opening 11. Three spaced securing members 14 are provided around the opening .11 An annular tray 20 is engaged in the opening 11 for receiving and collecting fluid, water and oil, and includes an open top having an annular partition 21 extended upward from the middle portion of the annular tray 20 so as to form two annular spaces within the tray 20. The annular partition 21 includes an orifice 23 formed in the bottom portion for communicating the two annular spaces with each other. The tray 20 further includes a drain hole 22 formed in the bottom portion and preferably located beside the orifice 23 of the partition 21, best shown in FIG. 4, for draining the fluid. The annular tray 20 includes three apertures 24 for engaging with three retaining devices 25 each of which includes an opening 26 formed therein.

Figure 2:
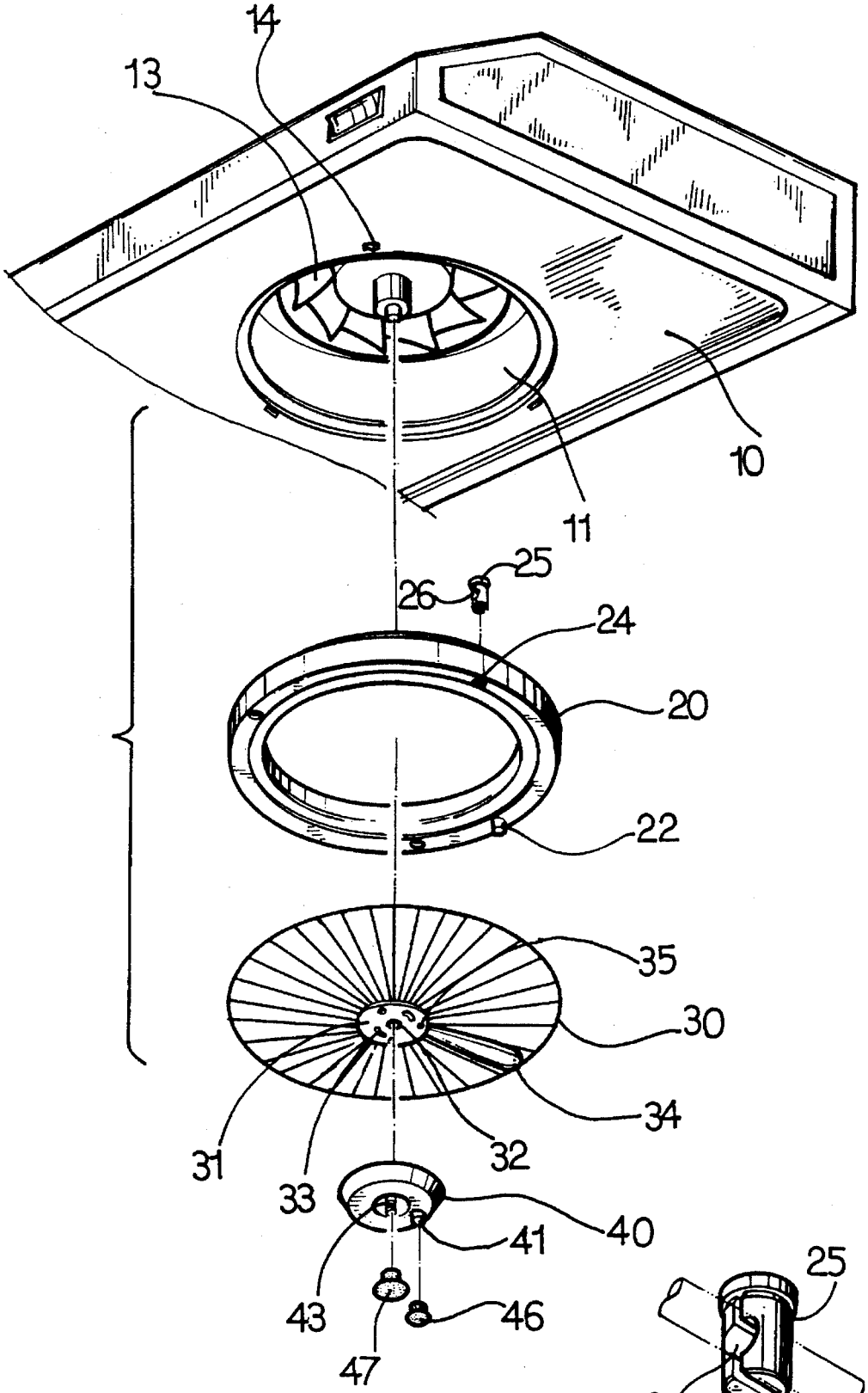
Figure 2A:
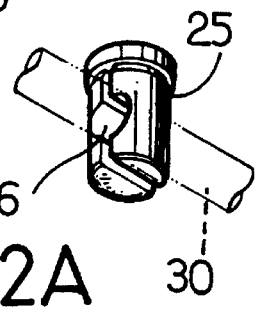
FIG. 2A is a perspective view showing a retaining device for securing the grill.
Figure 5:
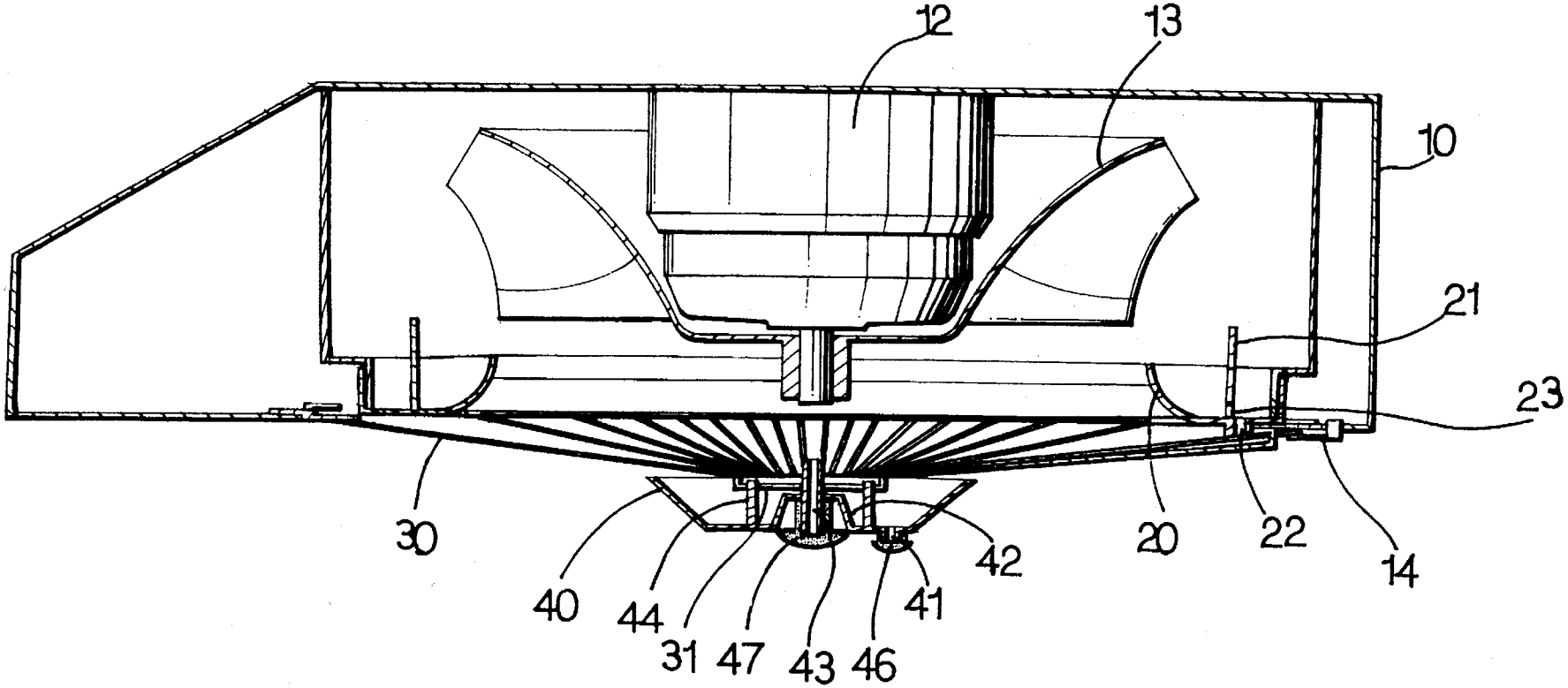

A grill 30 is disposed and engaged below the annular tray 20 and secured to the housing 10 by the three securing members 14, best shown in FIGS. 1 and 5. The grill 30 may further be engaged in the openings 26 and secured to the tray 20 by the three retaining devices 25 (FIGS. 1 and 2A). The grill 30 includes a basin 31 formed in the center portion. The basin 31 includes a bore 32 formed in the center portion, two or more apertures 35 formed therein and includes two curved grooves 33 oppositely formed beside the bore 32. A passage 34 extends radially in the grill 30 and includes one end located below the drain hole 22 of the tray 20 for receiving the fluid, and includes the other end extended toward the basin 31 for guiding the fluid to the basin 31.

A container 40 includes a drain hole 41 formed in the bottom and a hub 42 convex upward from the bottom of the center portion. A tube 43 is disposed vertically in the hub and has an upper end extended upward beyond the container 40 for engaging into the bore 32 of the basin 31. The basin 40 includes two posts 44 extended upward therein and having annular grooves 45 formed therein for engaging with the curved grooves 33 of the basin 31. The grooves 33 each includes one end having enlarged size for engaging with the posts 44 and the other end having reduced size for engaging with the annular grooves 45 so as to retain the container 40 to the basin 31, best shown in FIGS. 3 and 5. The container 40 is located below the apertures 35 of the basin 30 for receiving the fluid collected within the basin 30. Two plugs 46, 47 are provided for plugging the drain hole 41 and the tube 43 respectively for enclosing the same, such that the fluid may be collected within the container 40.

Figure 6:
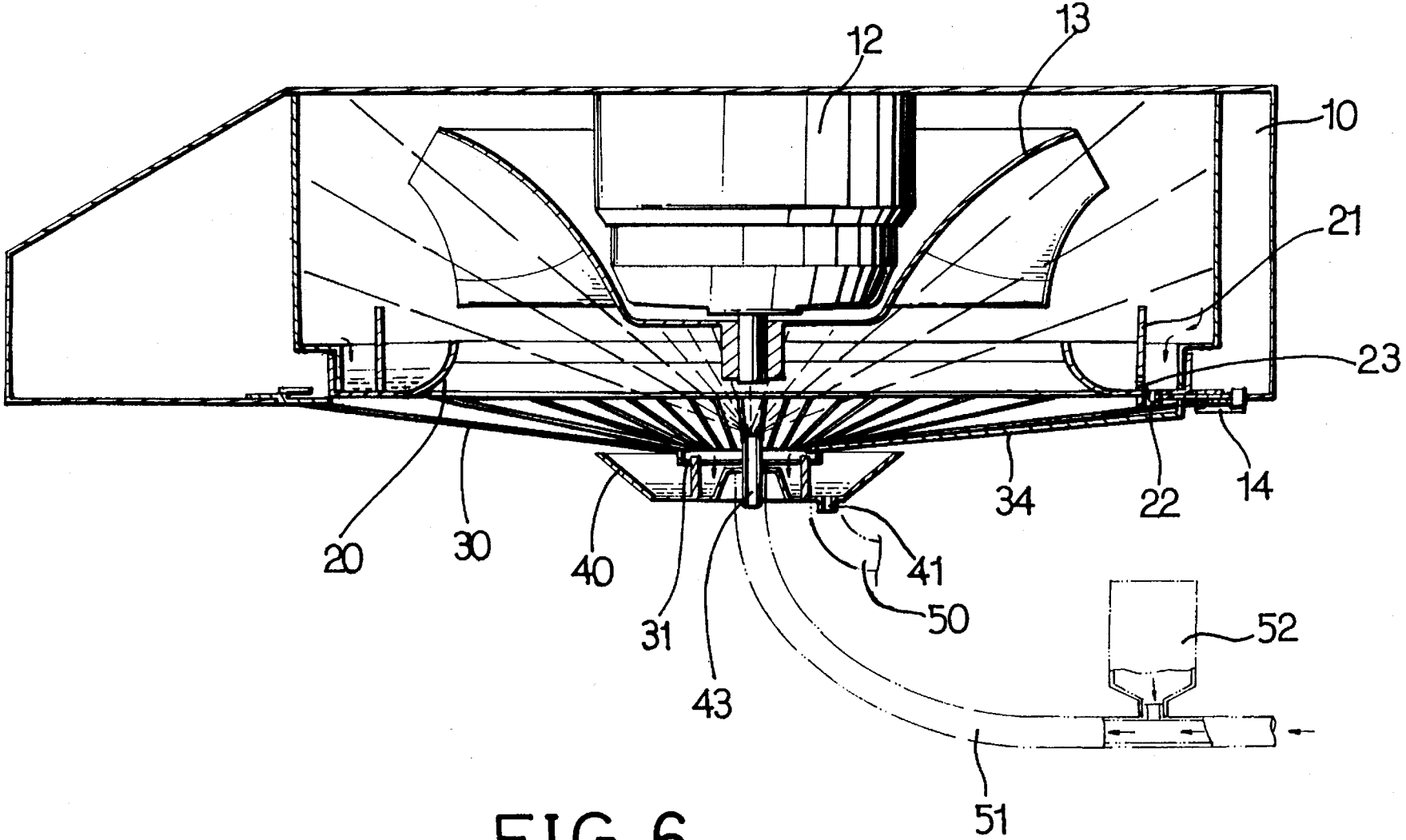
FIG. 6 shows the invention of FIG. 5 with plugs 46 and 47 removed and hoses 50, 51 and detergent receptacle 52 shown attached in dashed lines.

Referring next to FIG. 6, and again to FIG. 1, when the plugs 46, 47 are disengaged from the drain hole 41 and the tube 43, a hose 50 may be coupled to the drain hole 41 for draining the fluid collected within the container 40. A pipe 51 may be coupled to the tube 43 by a hose coupler 55 and coupled to water reservoir for supplying water jet to clean the interior of the smoke exhauster. A detergent receptacle 52 may be coupled to the pipe 51 for supplying detergent into the cleaning water. It is to be noted that the annular partition 21 is provided for partially shielding the water jet.

It is further to be noted that the annular tray 20 and the grill 30 may both be easily retained within the opening 11 by the securing members 14. The grill 30 are not required to be secured to the tray 20 by the retaining devices 25. The fan 13 can be easily reached and disengaged from the smoke exhauster for cleaning purposes when the grill 30 and the tray 20 are disengaged from the opening 11.

Accordingly, no motor devices are required to be disposed within the smoke exhauster for generating water jet. The smoke exhauster in accordance with the present invention includes a configuration that is excellent for cleaning the smoke exhauster.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A smoke exhauster comprising:

a housing including an opening formed therein, an annular tray engaged in said opening for collecting fluid and including a first drain hole formed therein for draining said fluid, a grill engaged below said annular tray and engaged in said opening, said grill including a center portion and including a passage extended radially therein, said passage including a first end located below said first drain hole of said annular tray for receiving said fluid and including a second end extended toward said center portion thereof for guiding said fluid to said center portion, means for securing said grill to said housing and for retaining said annular tray in said opening, a container secured to said center portion of said grill for collecting fluid from said passage, said container including a center portion having a tube provided therein, said tube including an upper end extended toward said opening of said housing and including a lower end for supplying water into said housing for cleaning said housing.

2. A smoke exhauster according to claim 1, wherein said grill includes a basin provided in said center portion thereof, said passage is connected to said basin for guiding said fluid to said basin, said basin includes at least one aperture formed therein for draining said fluid to said container.

3. A smoke exhauster according to claim 1, wherein said annular tray includes an open top having an annular partition extended upward therefrom so as to define two annular space in said annular tray, said annular partition includes an orifice formed therein for communicating said annular spaces.

4. A smoke exhauster according to claim 1, wherein said container includes a bottom portion having a hub convex upward therefrom, said tube is vertically secured in said hub.

5. A smoke exhauster according to claim 1, wherein said said container includes a second drain hole for draining said fluid.

* * * * *